US006959782B2

(12) United States Patent
Brower et al.

(10) Patent No.: US 6,959,782 B2
(45) Date of Patent: Nov. 1, 2005

(54) TUNED EXHAUST SYSTEM FOR SMALL ENGINES

(75) Inventors: David R. Brower, Beaver Dam, WI (US); John R. Mason, Plymouth, WI (US)

(73) Assignee: Tecumseh Products Company, Tecumseh, MI (US)

( * ) Notice: Subject to any disclaimer, the term of this patent is extended or adjusted under 35 U.S.C. 154(b) by 110 days.

(21) Appl. No.: 10/390,584

(22) Filed: Mar. 17, 2003

(65) Prior Publication Data

US 2005/0023078 A1 Feb. 3, 2005

Related U.S. Application Data

(60) Provisional application No. 60/366,733, filed on Mar. 22, 2002.

(51) Int. Cl.[7] ..... F01N 1/08; F01N 1/12; F01N 7/04

(52) U.S. Cl. ..... 181/272; 181/279; 181/238; 181/239; 181/275; 60/314

(58) Field of Search ..... 181/272, 274, 181/279, 269, 255, 249, 238, 239, 282, 275, 268, 257, 251; 123/65 EM; 60/314, 312

(56) References Cited

U.S. PATENT DOCUMENTS

| | | | | |
|---|---|---|---|---|
| 794,926 A | | 7/1905 | Crawford | 181/279 |
| 943,233 A | * | 12/1909 | Boyle | 181/279 |
| 969,101 A | | 8/1910 | Gibson | 181/279 |
| 1,058,393 A | | 4/1913 | Vaughn | 181/280 |
| 1,167,822 A | | 1/1916 | Howell | 181/279 |
| 1,353,478 A | | 9/1920 | Jeffries, Sr. | 181/279 |
| 1,396,583 A | | 11/1921 | Krafve | 181/279 |
| 1,481,479 A | | 1/1924 | Murphy | 181/279 |
| 1,601,136 A | * | 9/1926 | Maxim | 181/279 |
| 1,601,137 A | * | 9/1926 | Maxim | 181/279 |
| 1,658,126 A | | 2/1928 | Jehle | 181/279 |
| 1,695,435 A | * | 12/1928 | Maxim | 181/279 |
| 1,713,047 A | * | 5/1929 | Maxim | 60/314 |
| 2,073,218 A | * | 3/1937 | Mordt | 181/268 |
| 2,139,736 A | | 12/1938 | Durham | 181/58 |
| 2,908,344 A | | 10/1959 | Maruo | 181/59 |
| 2,912,063 A | * | 11/1959 | Barnes | 181/279 |
| 3,062,317 A | | 11/1962 | Pigman | 181/66 |
| 3,066,755 A | | 12/1962 | Diehl | 181/66 |
| 3,335,814 A | | 8/1967 | Arbeiter | 181/58 |
| 3,340,958 A | * | 9/1967 | Conlin | 181/274 |
| 3,530,953 A | * | 9/1970 | Conlin | 181/274 |
| 3,584,701 A | | 6/1971 | Freeman | 181/67 |
| 3,665,712 A | | 5/1972 | Tenney | 60/314 |
| 3,672,773 A | | 6/1972 | Moller | 181/58 |
| 3,692,142 A | | 9/1972 | Stemp | 181/50 |

(Continued)

FOREIGN PATENT DOCUMENTS

| | | | | |
|---|---|---|---|---|
| DE | 89 12 193 | | 11/1989 | |
| EP | 178080 A1 | * | 4/1986 | F01N/1/00 |
| JP | 57198310 A | * | 12/1982 | F01N/7/00 |
| JP | 09324711 A | * | 12/1997 | F02M/35/12 |
| WO | WO 88/09431 | | 12/1988 | |

*Primary Examiner*—Edgardo San Martin
(74) *Attorney, Agent, or Firm*—Baker & Daniels

(57) ABSTRACT

A tuned exhaust system for small two cylinder engines, the exhaust system including a pair of exhaust passage through which exhaust gasses pass. The exhaust passages are dimensioned to providing a tuning effect to the exhaust gasses for enhanced engine performance. The exhaust passages are not straight and elongated, but rather are sprialed, scrolled, coiled, or otherwise folded upon themselves at least twice. In this manner, the exhaust passages may be housed at least in part within a muffler having a significantly reduced overall size or profile, such that the muffler may be used in small engines.

13 Claims, 8 Drawing Sheets

U.S. PATENT DOCUMENTS

| | | | | |
|---|---|---|---|---|
| 3,786,791 | A | | 1/1974 | Richardson ..... 123/65 EM |
| 3,927,525 | A | | 12/1975 | Jacobs ..... 60/301 |
| 3,927,731 | A | | 12/1975 | Lancaster ..... 181/58 |
| 4,010,886 | A | | 3/1977 | Santos ..... 228/173 |
| 4,126,205 | A | | 11/1978 | Bauerschmidt ..... 181/256 |
| 4,579,195 | A | | 4/1986 | Nieri ..... 181/279 |
| 5,044,159 | A | | 9/1991 | Landfahrer et al. ..... 60/314 |
| 5,612,006 | A | | 3/1997 | Fisk ..... 422/171 |
| 5,729,973 | A | | 3/1998 | Zander et al. ..... 60/302 |
| 5,824,972 | A | | 10/1998 | Butler ..... 181/279 |
| 5,831,223 | A | | 11/1998 | Kesselring ..... 181/227 |
| 5,844,178 | A | | 12/1998 | Lothringen ..... 181/269 |
| 5,971,097 | A | | 10/1999 | Etheve ..... 181/227 |
| 6,052,990 | A | | 4/2000 | Gecker, Jr. ..... 60/312 |
| 6,089,348 | A | | 7/2000 | Bokor ..... 181/272 |
| 6,134,885 | A | | 10/2000 | Gilbertson ..... 60/312 |
| 6,283,162 | B1 | | 9/2001 | Butler ..... 138/177 |
| 6,296,074 | B1 | * | 10/2001 | Ridlen ..... 181/272 |
| 6,382,348 | B1 | * | 5/2002 | Chen ..... 181/239 |
| 6,684,633 | B2 | * | 2/2004 | Jett ..... 60/312 |
| 2004/0074694 | A1 | * | 4/2004 | Heed ..... 181/228 |

* cited by examiner

TUNED EXHAUST SYSTEM FOR SMALL ENGINES

CROSS REFERENCE TO RELATED APPLICATIONS

This application claims the benefit under Title 35, U.S.C. § 119(e) of U.S. Provisional Patent Application Ser. No. 60/366,733, entitled TUNED EXHAUST SYSTEM FOR SMALL ENGINES, filed on Mar. 22, 2002.

BACKGROUND OF THE INVENTION

1. Field of the Invention

The present invention relates to mufflers for use with small engines, such as engines of the type used with lawnmowers, lawn tractors, and other lawn and garden implements, as will as in sport vehicles.

2. Description of the Related Art

Typically, mufflers used with small engines are attached directly to the exhaust port or ports of the engine cylinder head, or alternatively, may be mounted remotely from the engine and attached to the exhaust port or ports of the engine cylinder head by one or more exhaust pipes communicating exhaust gasses from the cylinder head to the muffler. The construction of such mufflers varies greatly. However, such mufflers often include a muffler shell having a muffler tube disposed therein, the muffler tube having a plurality of holes for silencing the noise associated with the exhaust gasses. The exhaust gasses typically exit the muffler either through an open end of the muffler tube or through holes or slots in the muffler shell.

Some exhaust systems have additionally included exhaust tuning features to enhance engine performance in addition to reducing exhaust noise. For example, one method of exhaust tuning involves the use of a straight, elongated exhaust pipe which includes an area of expanding cross section, allowing the exhaust gasses to expand when passing therethrough. In this manner, when the exhaust gasses encounter the area of expanding cross section of the exhaust pipe, the expanding of the pressure waves associated with the exhaust gasses reflect negative pressure waves back toward the exhaust port. These reflected, negative pressure waves aid in scavenging exhaust gasses from the combustion chamber of the cylinder through the exhaust port, which in turn allows a greater amount of air/fuel combustion mixture to enter the combustion chamber to enhance engine performance.

Problematically, such tuned exhaust systems often require very lengthy straight exhaust piping, which is not practical for use in the mufflers of smaller engines because such engines are designed to be compact in size.

What is needed is a compact muffler for use in small engines, such as those used in the lawn and garden industry, which includes exhaust tuning features to enhance engine performance and provide improved exhaust noise reduction.

SUMMARY OF THE INVENTION

The present invention is a tuned exhaust system for small two cylinder engines, the exhaust system including exhaust passages, one corresponding to each engine cylinder, through which exhaust gasses pass. The exhaust passages are shaped and dimensioned to providing a tuning effect to the exhaust gasses for enhanced engine performance, which is typically exhibited in increased engine horsepower. The exhaust passages are not straight and elongated, but are rather sprialed, scrolled, coiled, or otherwise shaped such that the exhaust passages are folded upon themselves at least twice. In this manner, the exhaust passages may be housed at least in part within a muffler having a significantly reduced overall size or profile, such that the muffler may be used in small two cylinder engines.

An exemplary muffler for a two cylinder engine generally includes a muffler shell having a pair of scroll members which define a pair of separate spiral or scrolled exhaust passages, one for each cylinder, which provide a tuning effect to the exhaust gasses. When the exhaust gas pulses encounter a portion of the exhaust passage having an expanding cross section, negative pressure waves are sent back through the exhaust passage to the exhaust port of the engine cylinder to aid in evacuating exhaust gasses from the engine combustion chamber. After exiting the spiral exhaust passages, the exhaust gasses pass into a common muffler tube, and exit through a plurality of holes on opposite ends of the muffler tube into a pair of first expansion chambers defined by annular ring baffles. After exiting the first expansion chamber through a plurality of holes in the ring baffles, the exhaust gasses pass into a second expansion chamber defined by the muffler shell before exiting the muffler through slots in the muffler shell.

The scroll members may include a plurality of bleed holes which allow high frequency noise waves to pass therethrough to "shortcut" the turns of the exhaust passage, such that high frequency noise waves in different turns of the spiral exhaust passage encounter one another to set up an interference pattern to reduce high frequency exhaust noise. The bleed holes also serve to reduce the pressure of the exhaust wave fronts passing through the spiral passage.

Additionally, the first and second expansion chambers of the muffler, as well as the plurality of slots and holes in the muffler tube, and the ring baffles, combine to randomize the noise waves associated in the exhaust gasses, producing an interference effect which further reduces noise.

Advantageously, the exhaust passages are spiraled, scrolled, coiled, or otherwise shaped such that the exhaust passages are folded back upon themselves at least twice to reduce the space occupied by the exhaust passages, and therefore the exhaust passages may be housed at least at part within compact mufflers which are sized for use with small engines. The overall length of the exhaust passages may be selected to provide an exhaust tuning effect to enhance the performance of the engines.

Additionally, the mufflers disclosed herein combine noise attenuation features such as expansion chambers and perforated tubes with the tuned exhaust system for further noise reduction in addition to enhanced engine performance.

In one form thereof, the present invention provides a muffler for a two cylinder internal combustion engine, including a housing having two muffler inlets respectively connected to the engine cylinders, and at least one muffler outlet; two exhaust passages disposed within the housing, one associated with each inlet, the exhaust passages each folded upon themselves at least twice and shaped to provide an exhaust tuning effect to increase the output power of the engine.

In another form thereof, the present invention provides a muffler for a two cylinder internal combustion engine, including a muffler housing having two inlets in respective communication with the engine cylinders and at least one muffler outlet; two exhaust passages disposed within the muffler housing, each exhaust passage folded upon itself at least twice, the exhaust passages in respective communication with the inlets and in communication with the at least one outlet.

In a further form thereof, the present invention provides, in combination, an internal combustion engine having two cylinders; and a muffler, including a housing having two muffler inlets respectively connected to the engine cylinders, and at least one muffler outlet; two exhaust passages disposed within the housing, one associated with each inlet, the exhaust passages each folded upon themselves at least twice and shaped to provide an exhaust tuning effect to increase the output power of the engine.

BRIEF DESCRIPTION OF THE DRAWINGS

The above-mentioned and other features and advantages of this invention, and the manner of attaining them, will become more apparent and the invention itself will be better understood by reference to the following descriptions of embodiments of the invention taken in conjunction with the accompanying drawings, wherein.

Corresponding reference characters indicate corresponding parts throughout the several views. The exemplifications set out herein illustrate exemplary embodiments of the invention, and such exemplifications are not to be construed as limiting the scope of the invention in any manner.

DETAILED DESCRIPTION

Figure 1:
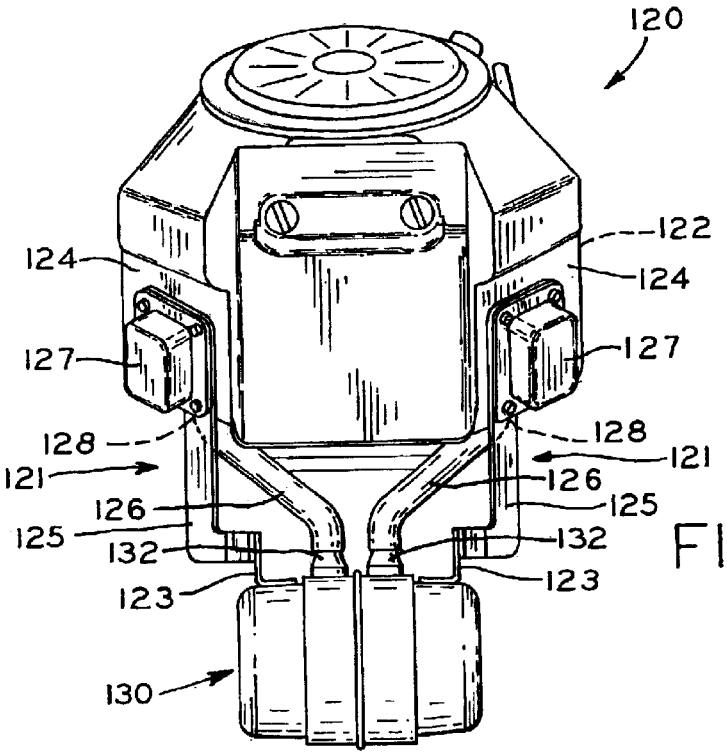
FIG. 1 is a perspective view of a twin cylinder engine including a muffler in accordance with the present invention.
Figure 2:
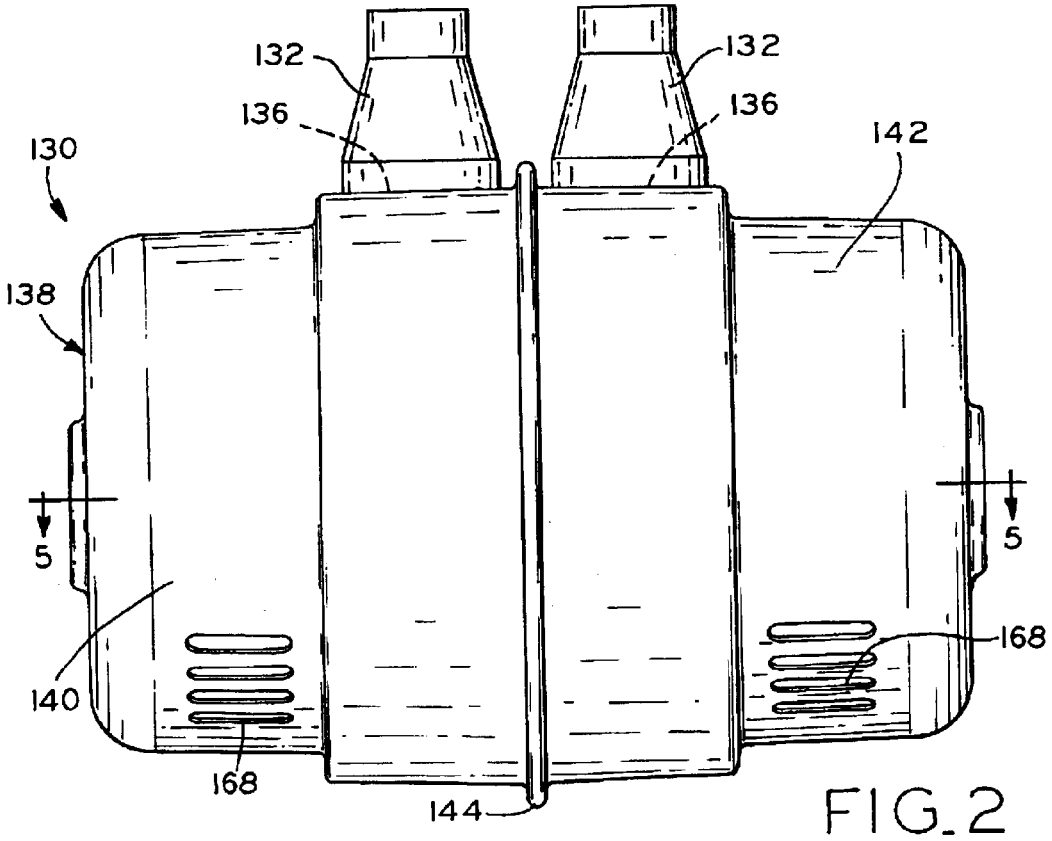
FIG. 2 is a front elevational view of the muffler of FIG. 1.
Figure 3:
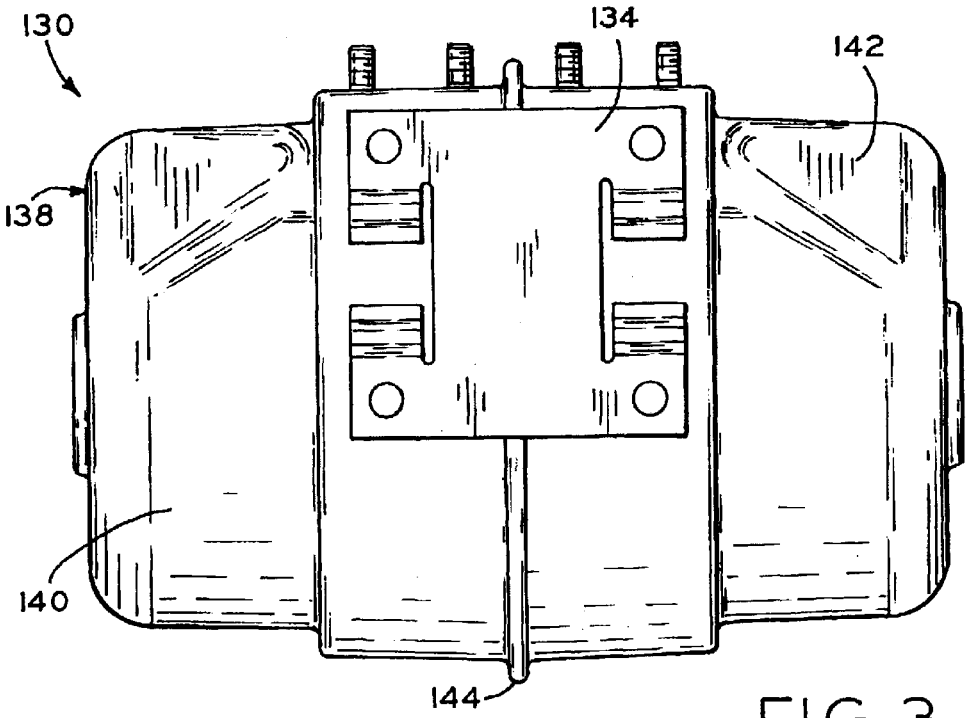
FIG. 3 is a rear elevational view of the muffler of FIG. 1.

In FIG. 1, V-twin engine 120 is shown, including crankcase 122 to which are attached a pair of cylinders 124. Pistons (not shown) reciprocate within the cylinders to drive the crankshaft (not shown) of engine 120. Engine 120 may be, for example, a V-twin engine such an Enduro® VT engine manufactured by Tecumseh Products Company. A pair of exhaust pipes 126 connect exhaust ports 128 of cylinder heads 124 to manifolds 132 of muffler 130. Alternatively, muffler may include a single manifold to which exhaust pipes are attached. As shown in FIG. 1, muffler 130 is attached to engine 120 by mounting assemblies 121, which include L-shaped brackets 123 mounted to muffler 130, and mounting members 125 connecting L-shaped brackets 123 to engine 120, wherein mounting members are attached between cylinders heads 124 and cylinder head covers 127 of engine 120. Also, muffler 130 includes mounting plate 134 (FIGS. 3 and 4) to facilitate attachment of muffler 130 to the frame of an implement (not shown) with which engine 120 is used.

Figure 4:
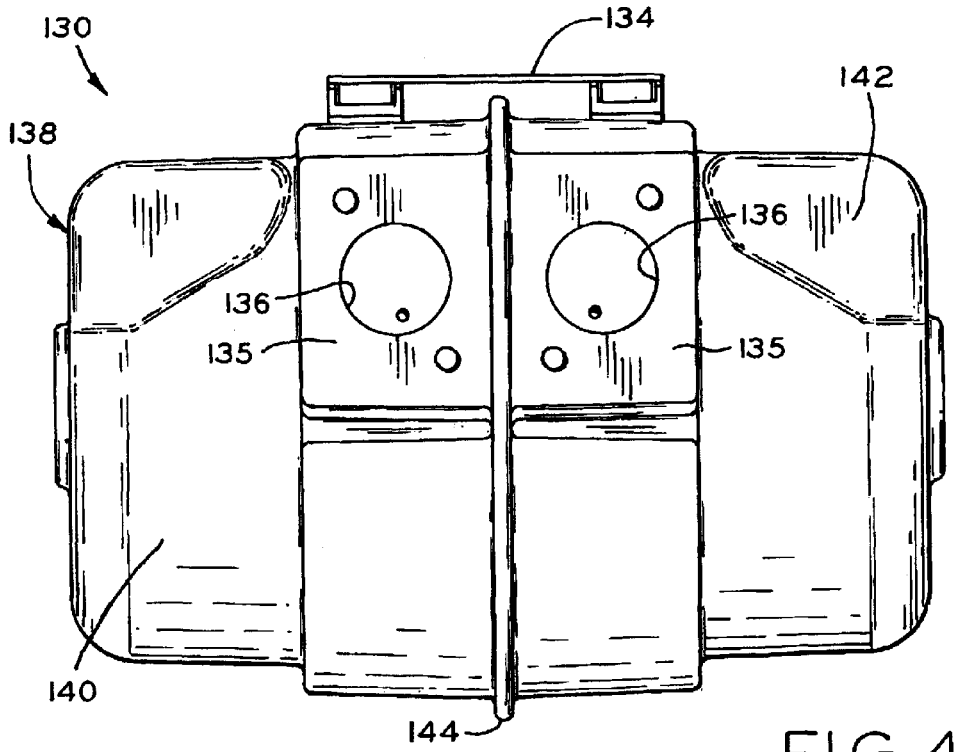
FIG. 4 is a top view of the muffler of FIG. 1.
Figure 5:
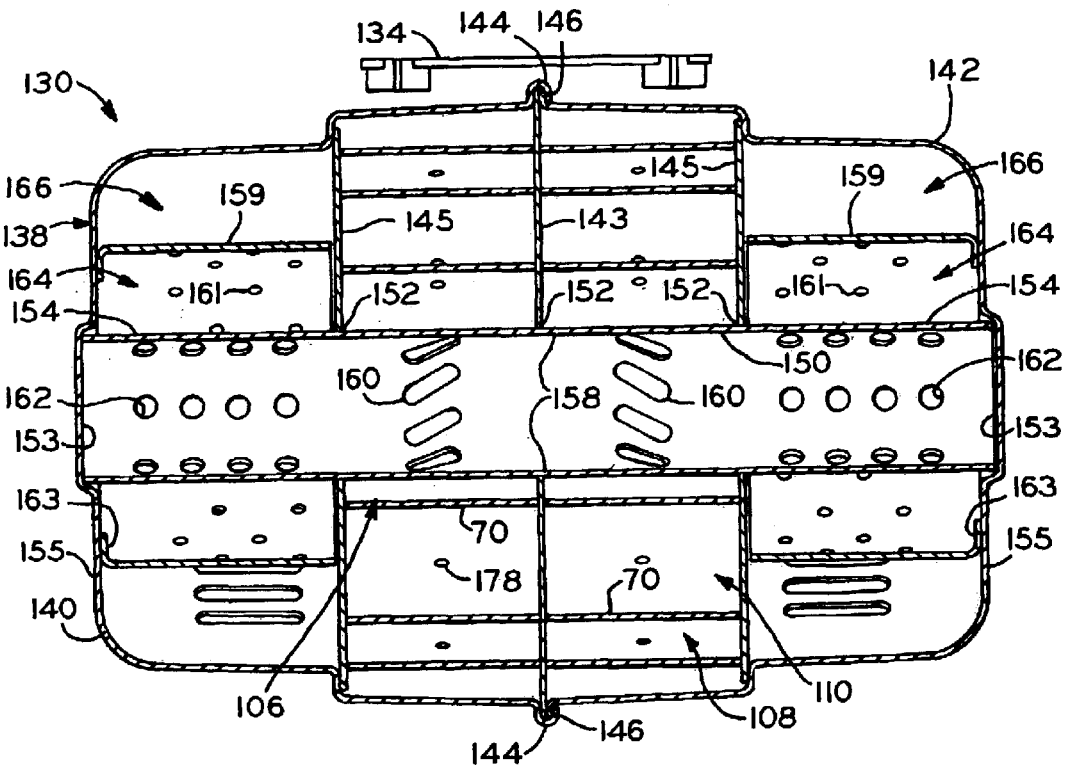
FIG. 5 is a sectional view of the muffler of FIG. 2, taken along line 5—5 of FIG. 2.

Muffler 130, for a two-cylinder engine, is shown in FIGS. 2–6, 9, and 10. Referring to FIG. 4, muffler 130 includes attachment plates 135 with inlet openings 136 therein into which exhaust gasses pass from manifolds 132. Muffler 130 includes muffler shell 138 having first and second shell halves 140, 142 which are substantially bowl shaped with open ends. As shown in FIG. 5, first shell half 140 includes curved lip 144 around the periphery of the open end thereof for attachment with out-turned lip 146 around the outer periphery of the open end of second shell half 142, such as by welding. Central plate 143 of muffler 130 is captured between lip 144 of first shell half 140 and lip 146 of second shell half 142.

A pair of scroll members 70 are disposed on each side of central plate 143, and, together with central plate 143 and side plates 145, define a pair of spiral exhaust passages 100 each having inlet end 102 disposed at the outer periphery thereof, and outlet end 104. Scroll members 70 may be made of a suitable metal, such as sheet metal or stainless steel, for example. Exhaust passage 100 includes a first portion 108 extending from inlet end 102 of scroll member 70, which spirals inwardly toward outlet end 104 and merges with a second portion 110 in transition area 112. First portion 108 of exhaust passage 100 has a constant cross-section which is shown as substantially rectangular. Second portion 110 of exhaust passage 100 extends from transition area 112, and spirals inwardly to outlet end 104. Second portion 110 has an expanding or diverging cross-section such that the width thereof gradually increases as second portion 110 of exhaust passage 100 approaches outlet end 104.

Figure 6:
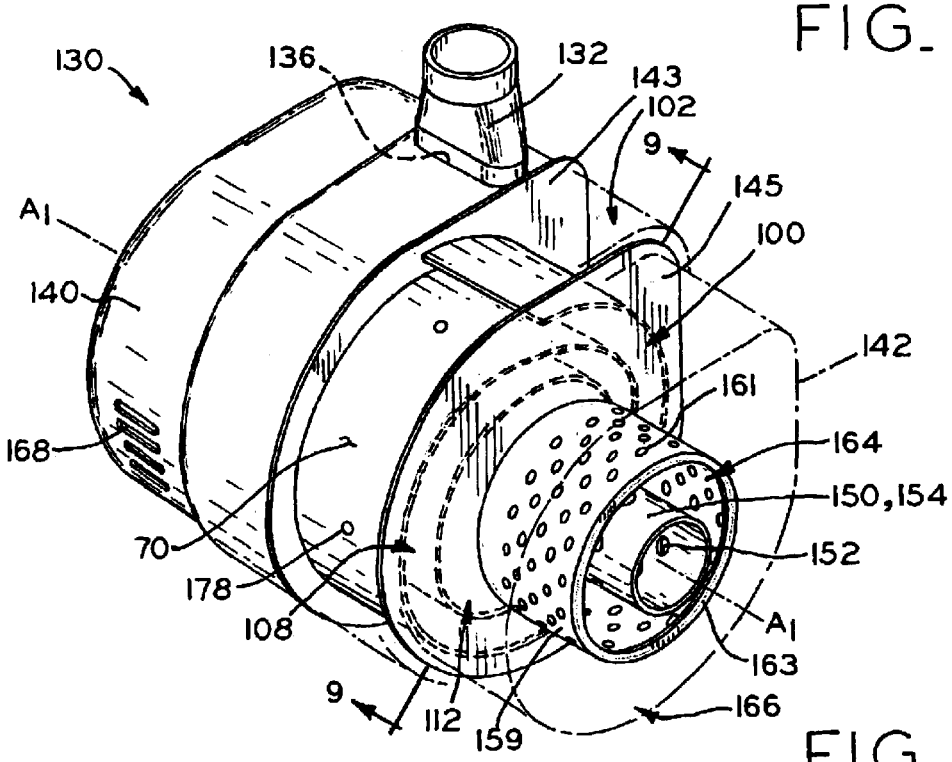
FIG. 6 is a perspective view of the muffler of FIG. 2, with one muffler shell half in dashed lines to show interior features of the muffler, including a scroll member, muffler tube, and ring baffle.

Muffler tube 150 is disposed laterally in muffler shell 138, and extends through open central portions 106 of scroll members 70 and openings 152 in each of central plate 143 and side plates 145. End portions 154 of muffler tube 150 are in abutment with recesses 153 in side walls 155 of first and second muffler shell halves 140, 142, such that end portions 154 of muffler tube 150 are closed. Muffler tube 150 includes central portion 158 with two sets of angled slots 160 therein, and further includes a plurality of holes 162 in end portions 154. Ring baffles 159 surround end portions 154 of muffler tube 150, and include a plurality of holes 161 therein, and in-turned annular flanges 163 welded to side walls 155 of first and second shell halves 140, 142. As shown in FIG. 6, muffler shell halves 140, 142, scroll members 70, muffler tube 150, and ring baffles 159 are generally disposed about a common central axis $A_1$—$A_1$ of muffler 130.

Referring to FIGS. 5 and 6, exhaust gasses enter muffler tube 150 from exhaust passages 100 through angled slots 160 in muffler tube 150, where the exhaust gasses from each engine cylinder are mixed, before exiting muffler tube 150 through openings 162 in end portions 154. The exhaust gasses, upon exiting muffler tube 150, enter first expansion chambers 164 defined by ring baffles 159, and subsequently may pass through holes 161 in ring baffles 159 into second expansion chambers 166 before exiting muffler 130 through a plurality of outlet slots 168 in each of first and second shell halves 140, 142. The sequential passing of exhaust gasses through slots 160, muffler tube 150, openings 162 in muffler tube 150, first expansion chamber 164, holes 161 in ring baffles 159, and second expansion chambers 166 randomizes the noise waves associated with the exhaust gasses, producing an interference effect which reduces exhaust noise.

Figure 10:
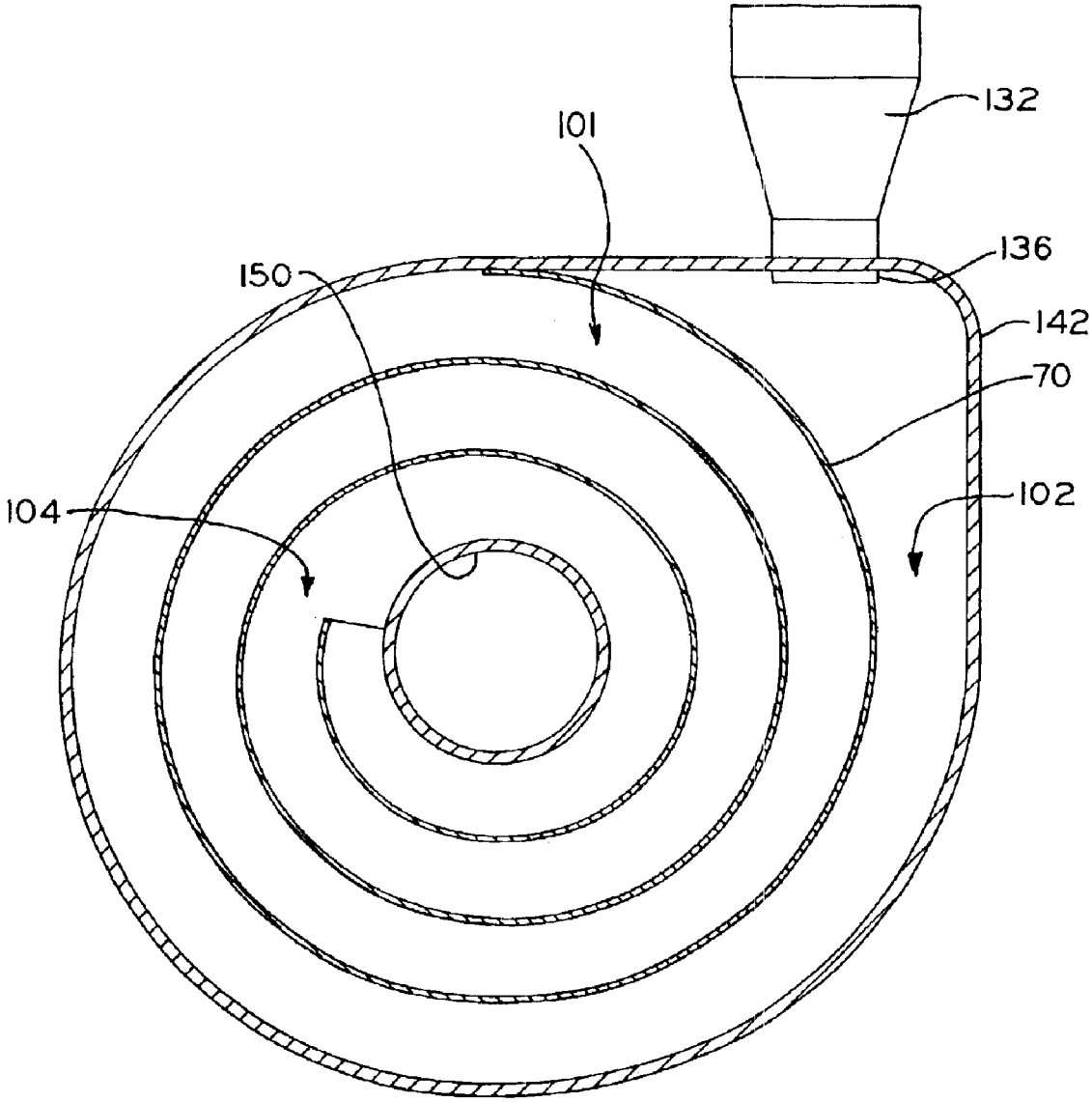
FIG. 10 is a sectional view similar to that of FIG. 9, showing an exhaust passage having a constant cross section.

In FIG. 10, a modified exhaust passage 101 for muffler 130 is shown. Exhaust passage 101 is defined by scroll member 71 having a constant cross section from inlet end 102 to outlet end 104 thereof, wherein inlet end 102 and outlet end 104 of exhaust passage 101 are each dimensioned equally to inlet end 102 of exhaust passage 100.

Figure 7:
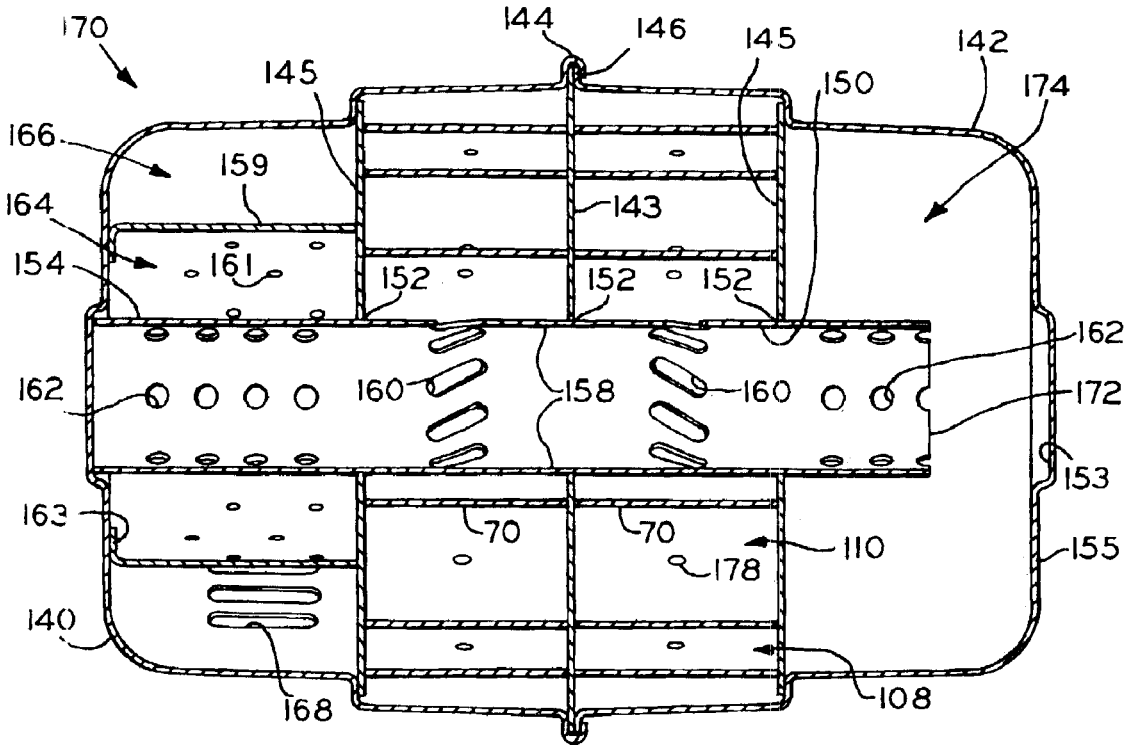
FIG. 7 is a sectional view of an alternate embodiment of a muffler for a twin cylinder engine, wherein the muffler tube includes an open end in communication with a resonance chamber.

An additional embodiment of a muffler for a twin cylinder engine is shown in FIG. 7. Muffler 170 is identical to muffler 130, except as explained hereinafter. In muffler 170, the outlet slots in the second shell half 142 have been omitted to define a closed resonance chamber 174. Additionally, the ring baffle within the second shell half has also been omitted. Muffler tube 150 includes an open outlet end 172, through which exhaust gasses may pass into resonance chamber 174, where the noise waves associated with the exhaust gasses may reflect and offset one another in an interference effect to provide further noise attenuation. The exhaust gasses then exit muffler 170 through outlet slots 168 in first shell half 140 after passing through first and second expansion chambers 164, 166 as described above with respect to muffler 130.

Figure 8:
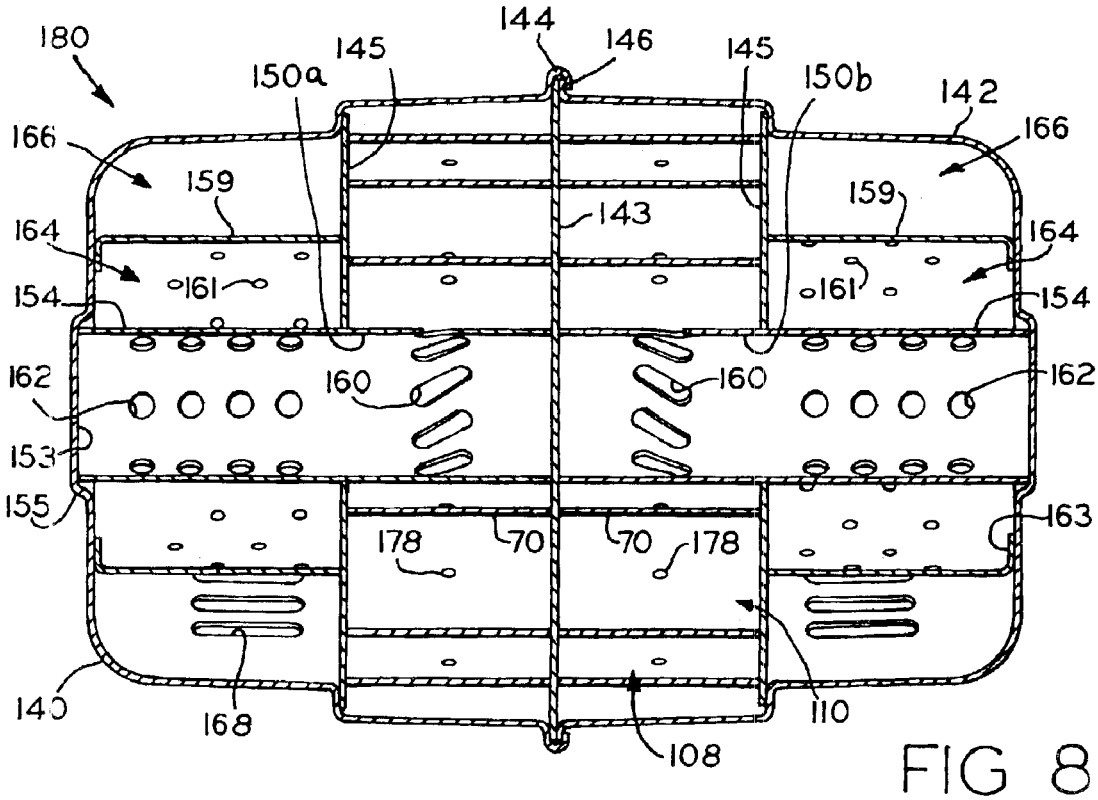
FIG. 8 is a sectional view of a further alternate embodiment of a muffler for a twin cylinder engine, wherein a central plate divides the muffler tube into first and second tubes to keep the exhaust gasses from each cylinder separated.
Figure 9:
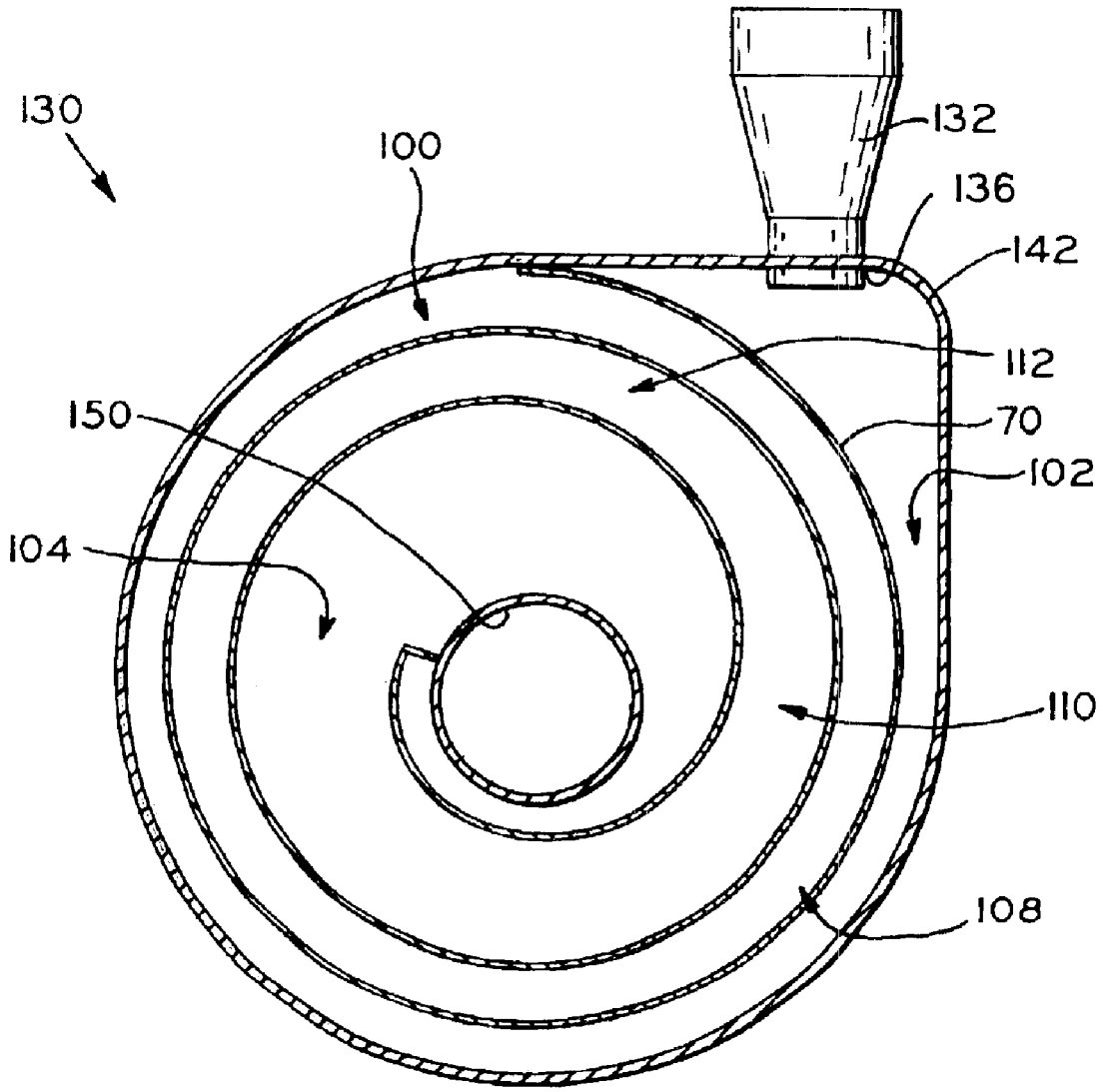
FIG. 9 a sectional view taken along line 9—9 of FIG. 6, showing the scroll member.

A further embodiment of a muffler for a twin cylinder engine is shown in FIG. 8. Muffler 180 is identical to muffler 130, except as explained hereinafter. In muffler 180, central plate 143*a* lacks opening 152 therein through which muffler tube 150 may pass, thereby completely bisecting first and second shell halves 140, 142 and effecting a complete separation of the exhaust gasses of the first and second engine cylinders. Thus, exhaust gasses from the first and second cylinders pass through separate first and second muffler tubes 150*a*, 150*b*, and exit muffler 180 as described above with respect to muffler 130.

Scroll members 70 may additionally include a plurality of bleed holes 178 spaced therearound, as shown in FIGS. 5, 6, 7, and 8. Bleed holes 178 allow high frequency waves associated with the exhaust gas pulses to pass therethrough, thereby "shortcutting" the turns within spiral exhaust passages 100 and setting up an interference effect between the high frequency waves to reduce high frequency exhaust noise. Scroll members 70 may additionally include sound absorbent material (not shown) therein along spiral exhaust passages 100 for further noise reduction. For example, a lining of insulation or steel wool could be disposed around the interior of scroll members 70 and held thereto by a perforated sheet of metal or a screen.

Figure 11:
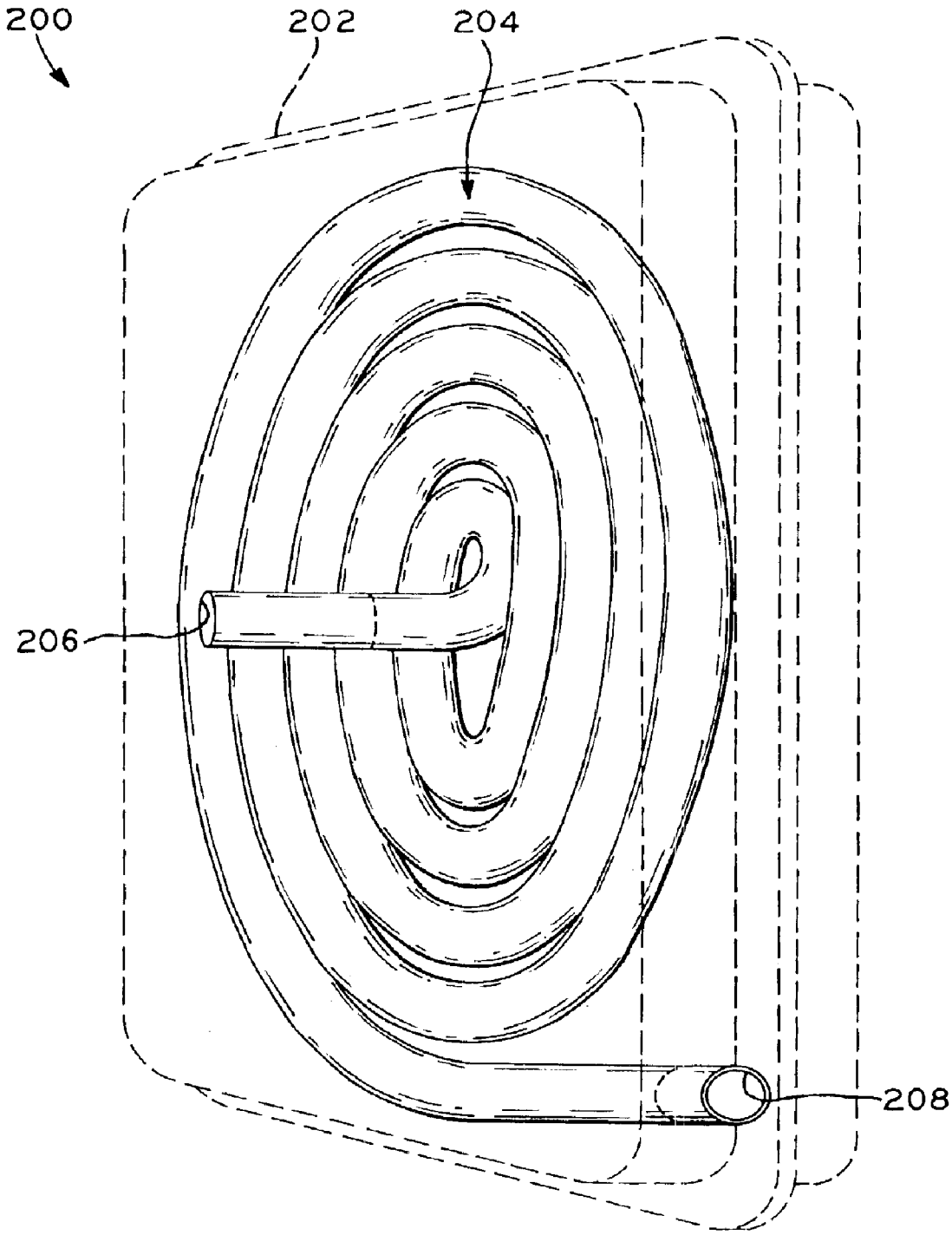
FIG. 11 is a perspective view of another exemplary exhaust passage which is generally coiled in shape, having inlet and outlet ends, housed within a muffler housing shown in dashed lines.

In FIG. 11, muffler 200 is shown, including housing 202 in which exhaust passage 204 is disposed. Exhaust passage 204 is shown in FIG. 11 as a tube having inlet and outlet ends 206 and 208, respectively. Optionally, end 206 could be an outlet end, and end 208 could be an inlet end. Further, exhaust passage 204 is shaped as a coil which is substantially disposed within a single plane.

Figure 12:
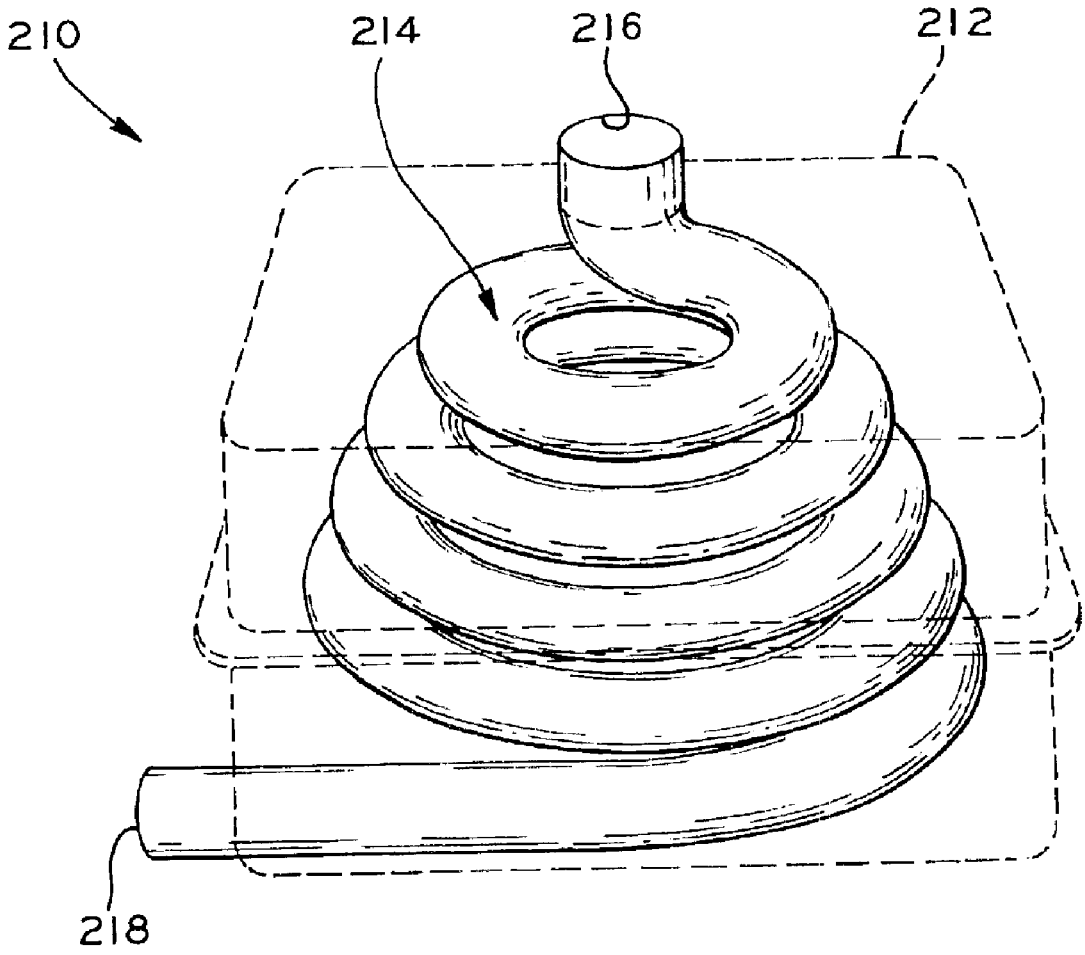
FIG. 12 is a perspective view of a further exemplary exhaust passage which is generally of a tapered spiral shape with a cone-type profile, having inlet and outlet ends, housed within a muffler housing shown in dashed lines.

In FIG. 12, muffler 210 is shown, including housing 212 in which exhaust passage 214 is disposed. Exhaust passage 214 is shown in FIG. 12 as a tube having inlet and outlet ends 216 and 218, respectively. Optionally, end 206 could be an outlet end, and end 208 could be an inlet end. Further, exhaust passage 214 is shaped as a tapering, spiral wrap having a generally cone-type profile, such that exhaust passage 214 is not disposed within a single plane.

Each of mufflers 130, 170, 180, 200, and 210, shown in FIGS. 1–12, include exhaust passages therein which are not straight and elongated, but rather are spiraled, scrolled, coiled, or otherwise folded at least twice upon themselves in shape. Advantageously, shaping such exhaust passages by bending same upon themselves reduces the size of the exhaust passages, such that same may be conveniently packaged in a compact manner within muffler shells having a reduced size and profile.

Further, the shape of the exhaust passages are selected to provide an exhaust tuning effect in order to enhance engine performance. Exhaust tuning is a technique which involves manipulating the flow of exhaust gasses from an internal combustion engine in a manner in which engine performance is increased, typically in the form of increased horsepower. Each time an engine exhaust valve opens, a pressure wave, associated with exhaust gases which are forced to evacuate the combustion chamber during the exhaust stoke of the piston, propagates through the fluid in the exhaust pipe at the speed of sound. In one form of exhaust tuning, these pressure waves expand upon reaching a change in cross-sectional area of the exhaust passage and/or the end of an exhaust passage.

The expansion of the pressure wave causes the wave to be reflected back through the exhaust passage to the exhaust port of the engine cylinder in a direction opposite the propagation of the exhaust gasses through the exhaust passage. In particular, the phase or timing of these reflective waves may be synchronized with the timing of the engine such that a negative peak of the reflective waves reaches the exhaust port of a given cylinder during the period of valve overlap within the engine cycle, just before the exhaust valve closes. In four-stroke engines, the valve overlap occurs around the top dead center (TDC) position of the piston in which the piston is completing its exhaust stroke and beginning its intake stroke, wherein the exhaust and intake valves are both open. When the reflective waves enter the cylinder at this time, the reflective waves aid in scavenging, or evacuating, residual combustion products such as exhaust gasses from the combustion chamber.

The more effective scavenging of exhaust gasses from the engine cylinder increases the efficiency of the entry of air/fuel combustion mixture into the combustion chamber and/or the amount of air/fuel combustion mixture which enters the combustion chamber, thereby providing enhanced engine performance. Thus, the variables that are considered to properly shape exhaust passages of a muffler in order to provide an exhaust tuning effect for a given engine include engine timing, speed of propagation of the exhaust pressure waves, and length and area of the exhaust passages.

For example, for a given engine, a tuned muffler may be designed as follows. First, a dynamometer may be used to measure engine power output, such as in horsepower, for an engine with a conventional muffler when the engine is running at its typical running speed and at typical load conditions. The conventional muffler is removed, and substituted with a straight exhaust pipe. A pressure transducer, mounted near the point of connection of the straight exhaust pipe to the exhaust port, provides a reading of exhaust pressure vs. time in the form of a pressure time history. The pressure time history can be superimposed upon a chart illustrating the engine timing, i.e., piston position, to correlate exhaust pressure with engine timing. Thereafter, the engine is run at its typical running speed with varying lengths of straight exhaust pipe and power readings are measured on the dynamometer, until a length of exhaust pipe is determined which provides the greatest power increase over the conventional muffler. Typically, the corresponding pressure time history will exhibit a negative exhaust pressure peak when the piston is at TDC.

A pipe having the same length as the straight pipe may then be formed in any desired shape, such as a spiral, coil, etc. Thereafter, using dynamometer and pressure readings, as well as suitable modeling tools, other dimensions of the muffler may be varied as needed to generate a suitable resonance frequency in the muffler for exhaust tuning, as well as to reduce back pressure in the muffler for better exhaust flow.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A muffler for a two cylinder internal combustion engine, comprising:

a housing having two muffler inlets respectively connected to the engine cylinders, and at least one muffler outlet;

two exhaust passages disposed within said housing, one associated with each inlet, said exhaust passages each folded upon themselves at least twice and shaped to provide an exhaust tuning effect to increase the output power of the engine, each said exhaust passage shaped as a spiral, including an exhaust passage inlet communicating with a respective said muffler inlet, and an exhaust passage outlet communicating with a respective said muffler outlet; and a pair of tubes disposed within said muffler housing around which said spiral exhaust passages are respectively disposed, said exhaust passage outlets in communication with a respective said tube, each tube in communication with a muffler outlet.

2. The muffler of claim 1, wherein the cross-sectional area of said exhaust passage inlet is less than the cross sectional area of said exhaust passage outlet.

3. The muffler of claim 1, wherein the cross-sectional area of said exhaust passage increases from said exhaust passage inlet to said exhaust passage outlet.

4. The muffler of claim 1, wherein each said tube includes an end portion communicating with an expansion chamber within said housing, each said expansion chamber communicating with a muffler outlet.

5. A muffler for a two cylinder internal combustion engine, comprising:

a muffler housing having two inlets in respective communication with the engine cylinders and at least one muffler outlet;

two exhaust passages disposed within said muffler housing, each said exhaust passage folded upon itself at least twice, said exhaust passages in respective communication with said inlets and in communication with said at least one outlet, wherein said muffler includes a pair of housing halves connected to one another with a dividing wall therebetween, with one each of said muffler inlet, exhaust passage, and muffler outlet disposed on each side of said dividing wall.

6. The muffler of claim 5, wherein said exhaust passages each have a spiral shape disposed about a central axis, including an exhaust passage inlet in communication with a respective said muffler inlet and an exhaust passage outlet in communication with said at least one muffler outlet.

7. The muffler of claim 6, wherein the cross-sectional area of said exhaust passage inlet is less than the cross sectional area of said exhaust passage outlet.

8. The muffler of claim 5, wherein said exhaust passages are formed in part of a strip of material wound in a spiral configuration including a plurality of turns, said strip having a plurality of apertures therein for allowing passage of exhaust gas therethrough.

9. The muffler of claim 6, wherein said exhaust passages have a common central axis and are disposed in a side-by-side relationship with one another.

10. The muffler of claim 5, further including a tube disposed centrally within said muffler housing along said central axis of said exhaust passages, each of said exhaust passage outlets in communication with said tube.

11. The muffler of claim 10, wherein said tube includes opposite end portions extending within said muffler housing outwardly of said exhaust passages.

12. The muffler of claim 10, wherein said tube includes opposite end portions, one end portion communicating with an enclosed expansion chamber, the other end portion communicating with a muffler outlet.

13. A muffler for a two cylinder internal combustion engine, comprising:

a muffler housing having two inlets in respective communication with the engine cylinders and at least one muffler outlet;

two exhaust passages disposed within said muffler housing, each said exhaust passage folded upon itself at least twice, said exhaust passages in respective communication with said inlets and in communication with said at least one outlet wherein said exhaust passages each have a spiral share disposed about a central axis, including an exhaust passage inlet in communication with a respective said muffler inlet and an exhaust passage outlet in communication with said at least one muffler outlet; and a pair of tubes disposed centrally within said muffler housing along said central axis of said exhaust passages and around which said spiral exhaust passages are respectively disposed, said exhaust passage outlets in communication with a respective said tube, each tube in communication with a muffler outlet.

* * * * *